US005707346A

United States Patent [19]

Graston

[11] Patent Number: 5,707,346

[45] Date of Patent: Jan. 13, 1998

[54] SYSTEM AND METHOD FOR PERFORMING SOFT TISSUE MASSAGE THERAPY

[75] Inventor: David A. Graston, Indianapolis, Ind.

[73] Assignee: Grastech, Inc., Indianapolis, Ind.

[21] Appl. No.: 515,374

[22] Filed: Aug. 15, 1995

Related U.S. Application Data

[63] Continuation-in-part of Ser. No. 299,201, Aug. 31, 1994, Pat. No. 5,441,478, which is a continuation of Ser. No. 83,029, Jun. 25, 1993, Pat. No. 5,366,437, which is a continuation of Ser. No. 758,871, Sep. 11, 1991, Pat. No. 5,231,977.

[51] Int. Cl.[6] ..... A61H 7/00

[52] U.S. Cl. ..... 601/137; 601/135

[58] Field of Search ..... 601/134, 135, 601/136, 137, 138; 606/237, 238

[56] References Cited

U.S. PATENT DOCUMENTS

| | | | |
|---|---|---|---|
| 26,798 | 3/1860 | Norton . | |
| 30,230 | 2/1860 | Barnet . | |
| 113,159 | 6/1871 | DeFelippis . | |
| 237,681 | 2/1881 | Fuller . | |
| 663,303 | 12/1900 | Sutton . | |
| 717,456 | 12/1902 | Schiele . | |
| 1,380,247 | 5/1921 | Price . | |
| 1,612,343 | 12/1926 | Amussen | 601/135 |
| 1,987,390 | 1/1935 | Davis | 601/135 |
| 2,044,112 | 6/1936 | Widmann | 128/67 |
| 2,477,666 | 8/1949 | Smallen | 601/135 |
| 2,478,786 | 8/1949 | Smallen | 601/137 |
| 2,694,396 | 11/1954 | Paschal | 128/67 |
| 2,777,440 | 1/1957 | Baker | 128/67 X |
| 2,806,470 | 9/1957 | Ferrier | 601/135 |
| 3,080,593 | 3/1963 | Wilson . | |
| 3,107,665 | 10/1963 | Nordgren | 601/134 |
| 3,389,418 | 6/1968 | Sencabaugh | 128/67 X |
| 3,773,051 | 11/1973 | Holcomb | 607/42 |
| 4,240,437 | 12/1980 | Church | 607/72 |
| 4,364,142 | 12/1982 | Pangle | 601/137 X |
| 4,483,328 | 11/1984 | Wolocko | 128/67 |
| 4,549,536 | 10/1985 | Verjabedian | 601/135 |
| 4,590,926 | 5/1986 | Courtin | 128/67 |
| 4,648,387 | 3/1987 | Simmons | 128/67 X |
| 4,705,030 | 11/1987 | Tepperberg | 128/69 |
| 4,776,835 | 10/1988 | Lee | 128/67 X |
| 4,936,293 | 6/1990 | Rymaruk | 128/67 X |
| 5,066,494 | 11/1991 | Becher | 424/448 |
| 5,190,456 | 3/1993 | Hasegawa | 433/120 |
| 5,387,231 | 2/1995 | Sporer | 607/48 |

FOREIGN PATENT DOCUMENTS

| | | |
|---|---|---|
| 120089 | 12/1956 | France . |
| 2523438 | 9/1983 | France . |
| 848544 | 9/1952 | Germany . |
| 909768 | 8/1954 | Germany . |

OTHER PUBLICATIONS

Harrigan, Joseph, "Soft Tissue Center—Therapy Facility of Tomorrow," *Ironman*, Jun. 1990, pp. 115–119.

Advertising brochure entitled "Therapy Plus—The Pain Reliever," date unknown, but believed to be before 1992.

Operations Handbook & Manual entitled "The Rich–Mar Theratouch 4.7," date unknown, but believed to be before 1994.

*Primary Examiner*—Michael A. Brown

*Attorney, Agent, or Firm*—Bose McKinney & Evans

[57] ABSTRACT

A method and a system for use by a trainer in performing soft tissue massage. The system includes a tool including a handle portion and a skin engagement portion that is configured to generally match the contour of the impaired area of soft tissue to be treated. The tool is connected to a source of electrical current for providing electrical stimulation to the impaired area during treatment with the tool. The skin engagement portion noninvasively engages the skin to allow the user to locate fibrous adhesions that are attached to the underlying soft tissue areas.

24 Claims, 6 Drawing Sheets

SYSTEM AND METHOD FOR PERFORMING SOFT TISSUE MASSAGE THERAPY

CROSS REFERENCE TO RELATED APPLICATIONS

This patent is a continuation-in-part of patent application Ser. No. 08/299,201, filed Aug. 31, 1994, now U.S. Pat No. 5,441,478, which was a continuation of patent application Ser. No. 08/083,029, filed Jun. 25, 1993, now U.S. Pat. No. 5,366,437, which was a continuation of patent application Ser. No. 07/758,871, filed Sep. 11, 1991, now U.S. Pat. No. 5,231,977.

BACKGROUND OF THE INVENTION

The present invention relates generally to a system and a method used by a trainer for the massaging of soft tissue areas of the body. More particularly, the present invention relates to the use of electrical stimulation therapy in conjunction with a set of tools for the therapeutic massaging of soft tissue areas of the human body.

Inflammation of soft tissue areas of the human body may occur in many ways. For example, inflammation may occur as the result of a major trauma, such as surgery, or as the result of repeated micro-trauma, such as overtraining. The body responds to such inflammation by forming fibrous adhesions, or scar tissue, as an unavoidable by-product of the healing process. The scar tissue forms in soft tissue areas of the body, such as muscles, tendons, and ligaments, and in the area between the muscle and the connective tissue (fascia). As scar tissue builds up, it prevents the muscles, tendons, and ligaments from properly lengthening and contracting, thereby resulting in lost range of motion, pain, and decreased stability. In addition, the build-up of scar tissue generally causes pain in the affected joint and surrounding areas. This pain often causes the sufferer to believe that an injury still exists; however, in most cases, the injury itself has healed. Therefore, it is desirable to loosen or remodel the scar tissue so that the joint may achieve a greater level of performance.

Scar tissue is removed or remodeled by a process known as soft tissue therapy, which involves use of the trainer's hand to manually massage the skin over the affected soft tissue areas to release scar tissue adhesions and regain lost resting length in the tissue. This type of massage includes cross-frictional massage, deep muscle massage, and rolfing.

One problem associated with manual massage of soft tissue areas is the difficulty in applying the appropriate amount of manual pressure. In some instances, too much pressure may be exerted by the trainer on some soft tissue areas, thereby causing unnecessary discomfort to the patient. In other instances in which hardened scar tissue has built up on tendons and ligaments near bone surfaces, the trainer may not be able to apply sufficient pressure with his or her hands to provide an effective treatment. In addition, it is frequently difficult for the trainer to manually locate or detect scar tissue with sufficient specificity using his or her hand. Furthermore, it has been found that performing manual massage for an extended period of time may result in injuries to the hand of the trainer, such as tendonitis.

Electrical stimulation therapy utilizes electrical current which is passed through a biological system to produce physiochemical and physiological effects on that system. Electrical stimulation therapy ("electrotherapy") is used in the treatment of a variety of debilitating conditions, and is frequently used in soft tissue therapy. For example, electrotherapy has been used extensively in pain management programs, muscle strengthening, iontophoresis, edema reduction, and in the stimulation of denervated muscle, among other uses. Each waveform generated by the source of the electrical current has certain aspects that are optimal for a particular physiological response. By varying the particular waveform, the therapist attempts to optimize the results of the treatment by matching the particular condition to be treated with the waveform most effective in that treatment. For example, classic, or Quadpolar Interferential is believed to be optimal for sensory stimulation. Symmetric, square-wave biphasic current is believed optimal for motor-fiber stimulation. Monophasic current may be used for wound care.

In addition, within each waveform a particular pulse rate may be selected for further optimization. In general, low pulse rates (0–10 Hz) are believed to be superior for more chronic problems, whereas higher pulse rates (80–200 Hz) are believed superior for treatment of acute problems. For example, direct current is believed to be the most effective waveform for treatment with iontophoresis, and also for the stimulation of denervated muscle. High voltage pulsed galvanic (HVPG) waves are preferred for use in edema reduction, pain management and muscle reeducation.

Trainers and physical therapists have found electrotherapy to be an effective tool in the treatment of inflammation of soft tissue areas of the body. Although, electrotherapy may be performed by the therapist prior to, in place of, or after the manual soft tissue therapy described above, it is most common to perform electrotherapy after completing soft tissue therapy. A frequent consequence of soft tissue therapy is a temporary condition of increased inflammation of the soft tissue ("edema"). This increased inflammation may be a result of the massage motion of the therapist's hands during the treatment, or a consequence of the breaking up of the fibrous scar adhesions from the impaired soft tissue area. Electrotherapy may then be utilized to reduce not only this inflammation, but also inflammation remaining from the underlying injury. In conventional electrotherapy, two electrodes are connected to a source of current. One of the electrodes (cathode) is applied at the site of the injury, and the other electrode (anode) is positioned in the vicinity of the "belly" of the muscle. The stimulating current passed through the resulting electrical circuit provides the well-known benefits of electrical stimulation therapy.

One of the disadvantages associated within conventional electrotherapy with regard to soft tissue injuries is that it is generally provided as a separate treatment step following the manual soft tissue therapy. As stated above, this sequence of treatment steps enables the therapist to treat not only the underlying inflammation caused by the original injury, but also any inflammation caused by the massage therapy. However, by adding this step to the treatment session, the length of that session is thereby extended if the patient is to receive the full benefits of the combined manual massage and electrotherapeutic techniques. A further disadvantage associated with conventional electrotherapy is that the conventional electrodes commonly used in this therapy do not provide the therapist with sufficient sensitivity with which to be sure that the electrode used to stimulate the fibrous adhesion is positioned on the patient's skin at the point of maximum benefit for the electrotherapy. Furthermore, when using circular padded electrodes of the type often used in conventional electrotherapy, the therapist is not able to specifically direct the current such that it flows between fibers directly to the source of the injury, to obtain optimal benefit from the treatment.

SUMMARY OF THE INVENTION

The present invention overcomes the aforementioned problems and disadvantages by providing a method and a system wherein a tool configured to generally match the contour of an impaired area of soft tissue to be treated is electrically connected to a source of current, wherein the skin over the affected area is massaged with the tool sufficiently to locate, loosen, break up, and remove fibrous scar adhesions from the impaired soft tissue area, and wherein the soft tissue area is stimulated by the current applied through the tool in a manner such that inflammation in the soft tissue area is simultaneously reduced.

In general, the invention provides a rigid tool connected to a source of electrical current. The tool has a handle portion and a skin engagement portion. The skin engagement portion includes an edge surface that engages the skin to noninvasively allow the user to locate fibrous adhesions that are attached to the underlying soft tissue areas. Thereafter, greater pressure may be applied with the edge surface to loosen the fibrous adhesions from the surrounding soft tissue areas. Then, the edge surface may be manipulated along the skin to break up the loosened fibrous adhesions and pull them away from the impaired soft tissue area.

An advantage of the present invention is that the use of the tool enables the trainer to locate fibrous adhesions on soft tissue surfaces that may not otherwise be located by hand therapy.

Another advantage of the present invention is that more pressure may be applied with greater specificity to the fibrous adhesions to more quickly and efficiently break up, loosen and remodel the adhesions from the soft tissue.

A further advantage of the present invention is that the tool allows the trainer to direct the applied pressure to the affected soft tissue areas and to minimize the pressure applied to unaffected soft tissue areas surrounding the fibrous adhesions, thereby minimizing discomfort to the patient.

Another advantage of the present invention is that the tool is configured to generally match the shape of the affected joint or soft tissue area so that more of the affected area may be massaged than by using one's hands, especially areas that may be difficult to reach and/or massage with one's hands.

Yet another advantage of the present invention is that the likelihood of hand injury such as tendonitis, to the trainer is minimized.

A still further advantage of the present invention is that a set of tools may be utilized to massage any selected soft tissue area of the body, whereby each tool of the set is configured to match the contour of a selected soft tissue area.

Another advantage of the present invention is that the use of electrical stimulation therapy in conjunction with the use of the unique tools enables the trainer to condense both soft tissue massage and anti-inflammation therapy into a single step.

Yet another advantage of the present invention is that the effectiveness of the electrical stimulation therapy is enhanced when the tool is used to provide the current directly into a specific localized area.

The present invention, in one form thereof, provides a system for use by a trainer for loosening fibrous scar tissue adhesions from underlying soft tissue of a patient. An elongate rigid body has a first end and a second end, a first flat surface and a second flat surface opposite from the first flat surface, and a peripheral edge extending about the circumference of the body. A portion of the peripheral edge is configured in the shape of an arc corresponding to the shape of a contour of a selected part of a patient's body from which a scar tissue adhesion is to be loosened from the underlying soft tissue, and a second portion of the peripheral edge includes a tapered surface to define an edge. A source of electrical current is electrically connected to the elongate body at an electrical connector on the body, for passing electrical current through the body to the scar tissue adhesion of the patient.

The invention further provides, in another form thereof, a method of loosening a fibrous scar tissue adhesion from underlying soft tissue of a patient. The method includes providing a massaging tool having a curvilinear skin-contacting portion generally matching the contour of the soft tissue, and providing a source of electrical current. An electrical connection is established by connecting the massaging tool to the source of electrical current via a cathode, and by connecting an anode to the source. The anode is spaced from the scar tissue adhesion in known fashion for electrotherapy. The curvilinear portion of the tool is passed across the skin of the patient in such a manner to cause noninvasive contact of the skin-contacting portion of the tool with the scar tissue adhesion sufficiently to loosen the adhesion from the soft tissue and to transmit electrical current from the tool to the scar tissue adhesion.

DESCRIPTION OF THE PREFERRED EMBODIMENT

Throughout this application, the terms "trainer" and "therapist" have been interchanged. These terms are not intended to be limiting, and are intended to be broadly construed to include, for example, physicians, trainers, physical therapists and related health care professionals.

Figure 1:
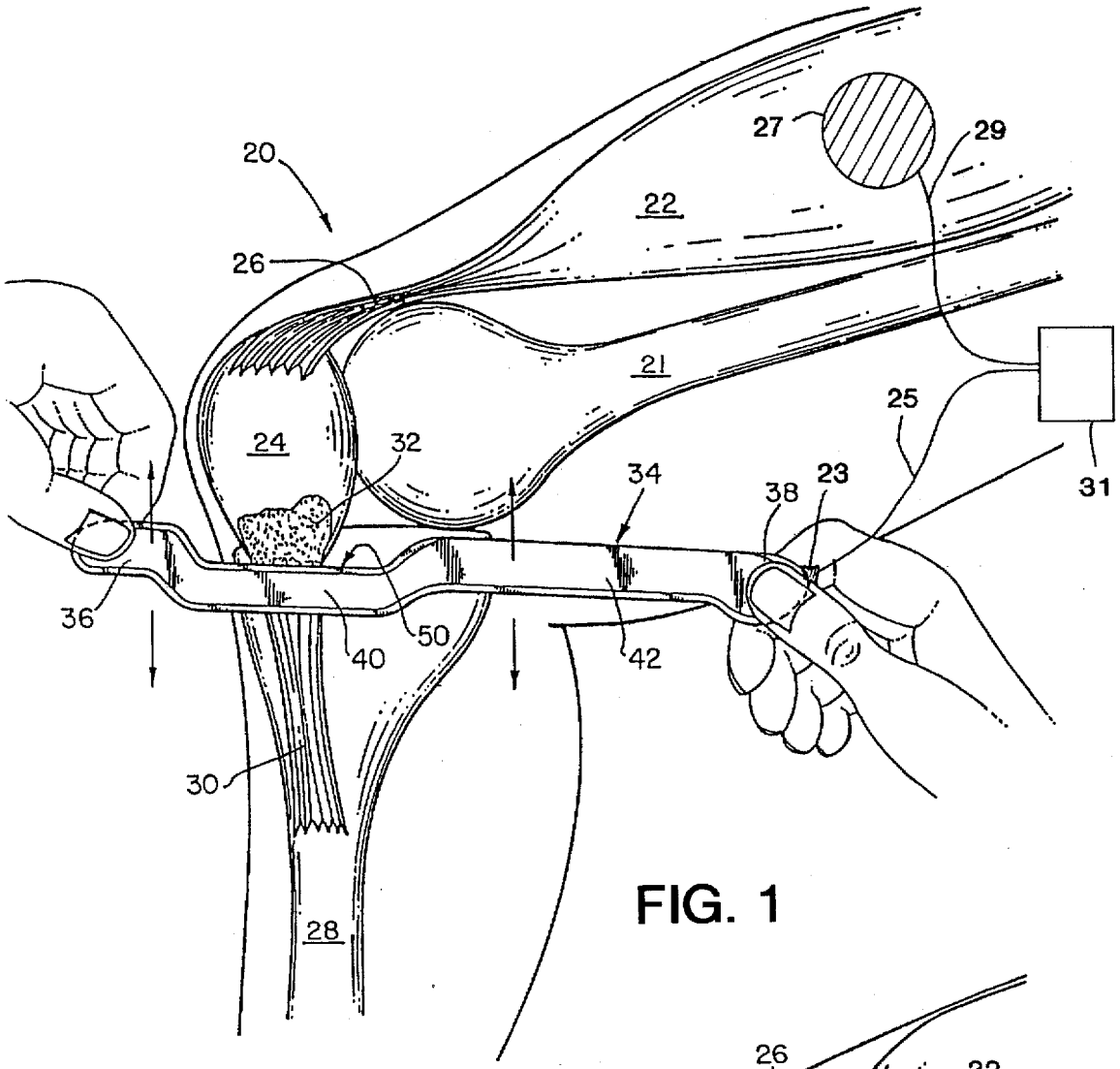
FIG. 1 is a perspective view with a human knee joint in cross-section, showing a tool according to the present invention engaging scar tissue that has built up on the ligament below the patella, and showing electrical connection of the tool to a source of electrical current.
Figure 2:
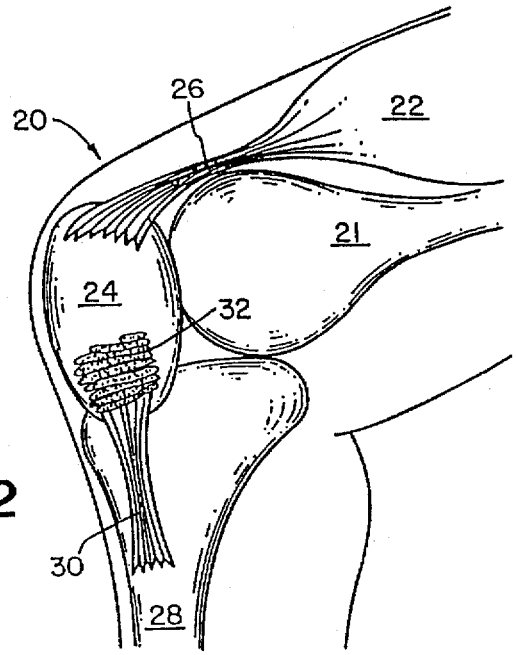
FIG. 2 is a view of the knee joint of FIG. 1, particularly showing layers of fibrous scar tissue adhesions and their attachment to the ligament.
Figure 3:
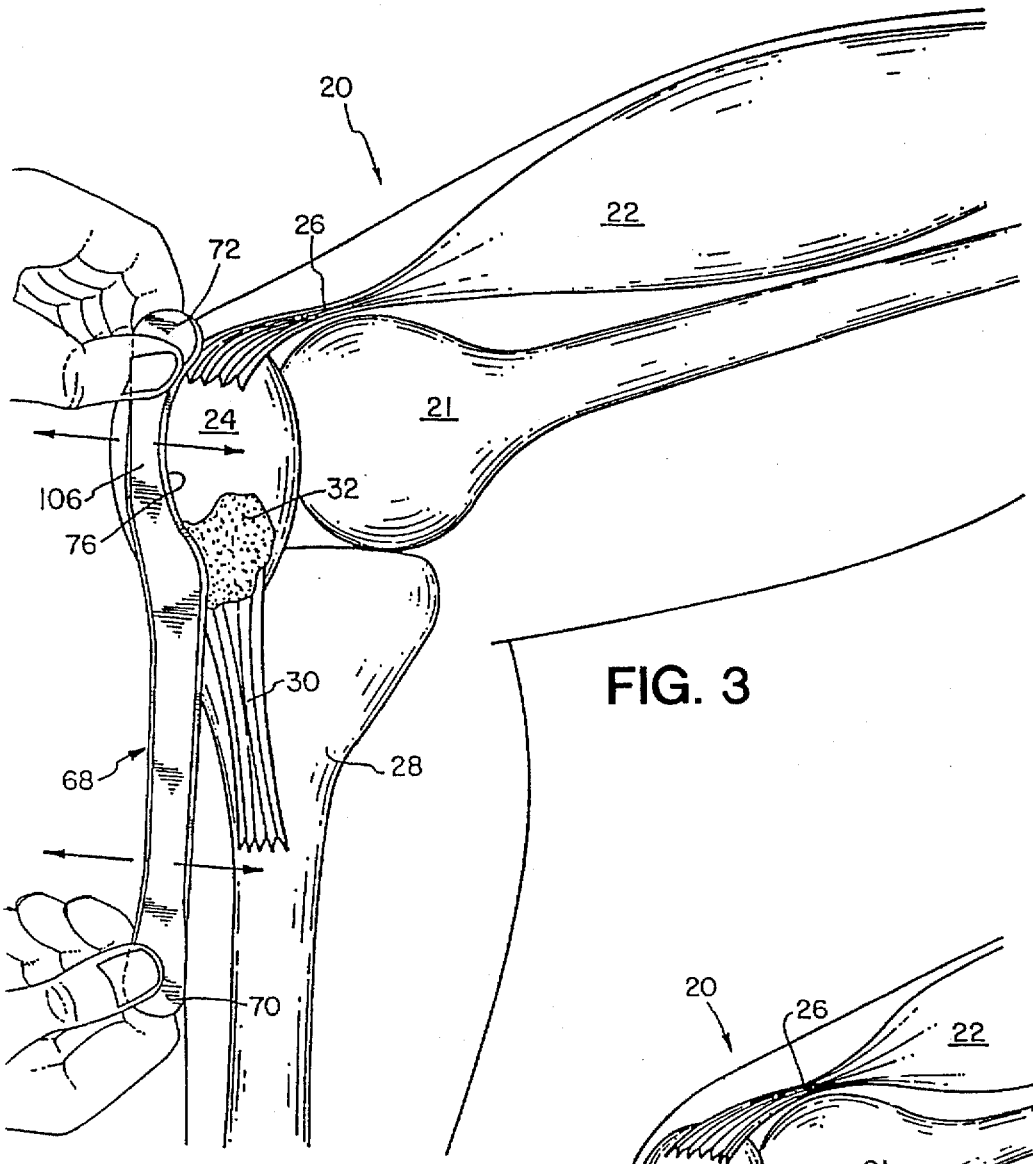
FIG. 3 is a view similar to that shown in FIG. 1, except that a different tool is being used to engage the scar tissue.
Figure 4:
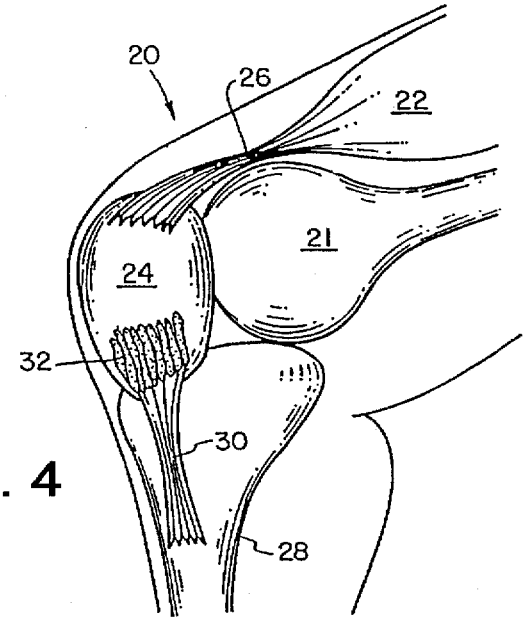
FIG. 4 is a side view of FIG. 3 again showing the layers of scar tissue built up on the ligament.

Referring now to the drawings, and in particular to FIG. 1, there is shown a human leg 20 having a femur 21 and a quadriceps muscle 22 that is attached to patella 24 by tendon 26. Similarly, there is shown a tibia 28 that is connected to patella 24 by a patellar ligament 30, which is subject to a great amount of stress and injury. It should be noted that in FIG. 1, as well as FIGS. 2–6, other soft tissue areas in the area of the knee joint have been omitted for the sake of clarity in the following description. Once injured, scar tissue, or fibrous adhesions 32 are formed on ligament 30 as a result of the healing process. As best shown in FIGS. 2 and 4, scar tissue 32 is made up of individual fibers bound together. As scar tissue 32 comes into contact with bone, in this case patella 24, it becomes hard and takes away flexibility in the lower knee joint. The scar tissue shown in FIGS. 1–6 is generally in a first phase. In more severe cases, scar tissue has advanced around the joint capsule and has formed on other adjacent soft tissue areas. It should be noted that the present invention is designed to remove or remodel scar tissue in varying degrees of advancement.

In accordance with one embodiment of the present invention, there is shown in FIG. 1 a rigid tool 34 for removing scar tissue 32 from patella 24 and ligament 30. Tool 34 is preferably made of stainless steel, although other suitably rigid materials such as aluminum may be utilized. Tool 34 generally comprises a handle portion and a skin-contacting portion, as well as opposite ends 36 and 38, which serve as handles. The handle portions are generally rounded to fit comfortably in the hands of the trainer. The skin-contacting portion includes "contoured" portions 40 and 42. Essentially, these portions of tool 34 are contoured to match the shape of the joint being massaged, thereby permitting greater coverage of the area to be massaged.

Figure 10B:
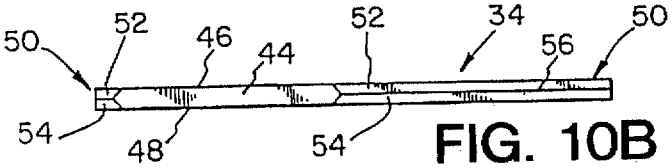
Figure 10A:
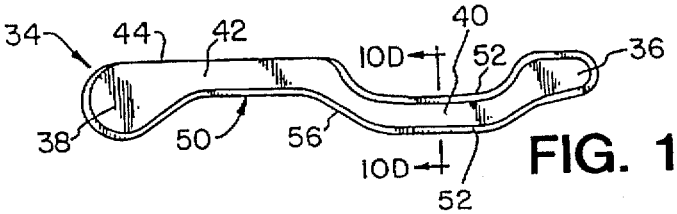
Figure 10D:
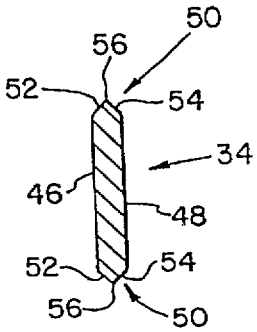
Figure 10C:
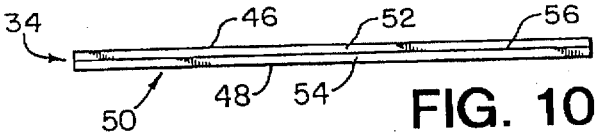
Figure 11B:
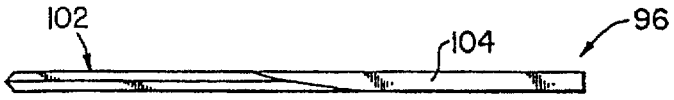
Figure 11A:
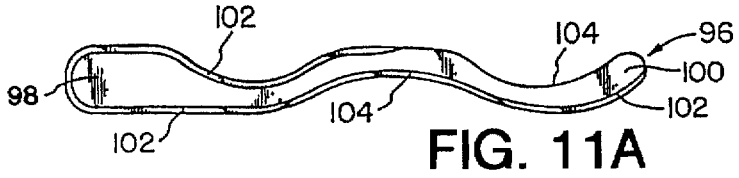
Figure 11C:
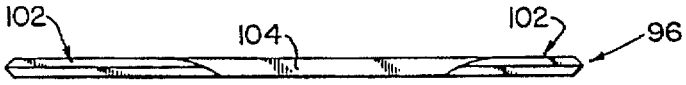
Figure 11D:
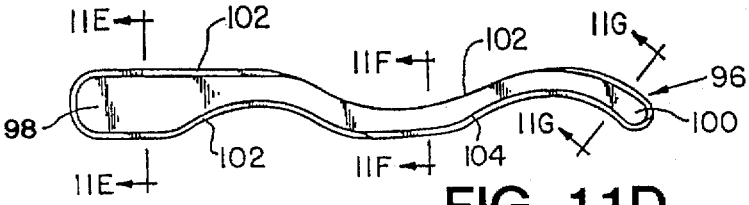
Figure 11E:
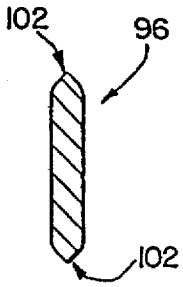
Figure 11F:
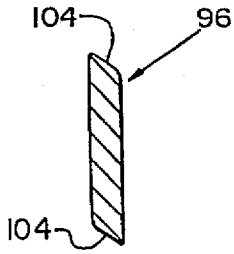
Figure 11G:
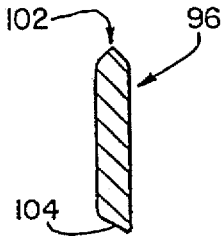

Referring to FIGS. 10A–10D, tool 34 includes an outer peripheral edge that varies along the circumference of the tool. One portion of the peripheral edge is a flat edge 44 which is generally a flat surface that is perpendicular to the top 46 and bottom 48 surfaces of tool 34 (FIG. 10B). A second portion of the peripheral edge is a so-called "bevelled" edge 50 and includes upper bevelled surface 52 and lower bevelled surface 54. Surfaces 52 and 54 may be bevelled at various angles with respect to top 46 and bottom 48 surfaces, respectively. As shown in FIG. 10D, surfaces 52 and 54 are bevelled at about 135° with respect to top 46 and bottom 48 surfaces, respectively. Surfaces 52 and 54 meet at edge 56.

Figure 7C:
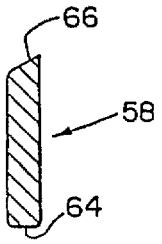
FIGS. 7A–7C, 8A–8D, 9A–9D, 10A–10D, and 11A–11G, show a variety of tools according to the present invention that may be utilized for the removal of scar tissue on different soft tissue areas of the body.
Figure 7B:
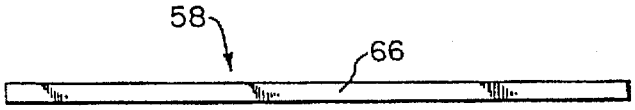
Figure 7A:
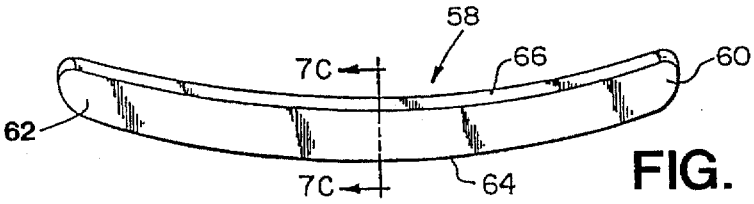
Figure 8B:
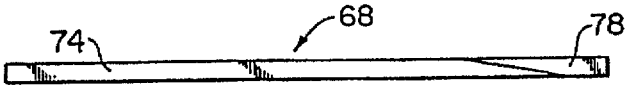
Figure 8A:
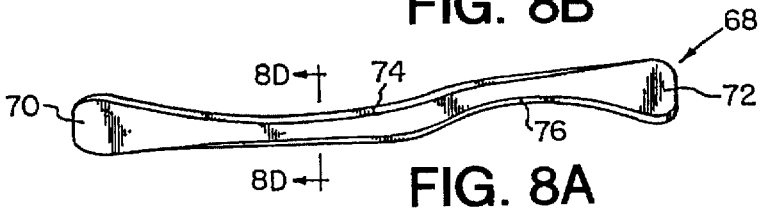
Figure 8D:
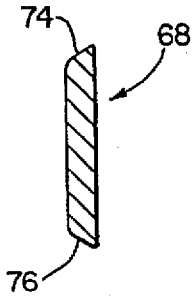
Figure 8C:
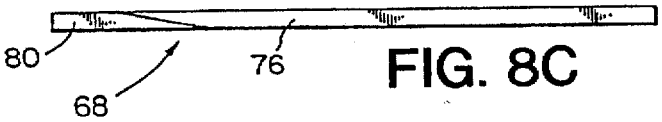
Figure 9B:
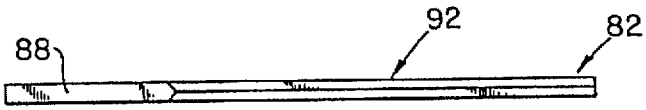
Figure 9A:
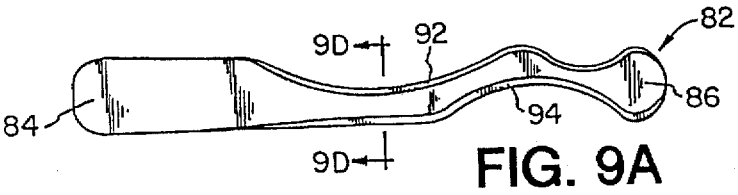
Figure 9D:
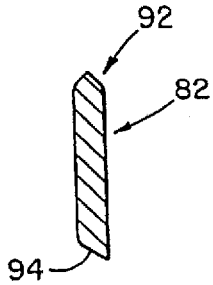
Figure 9C:
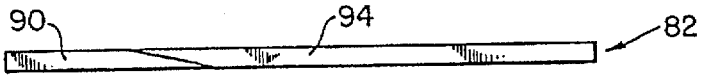

As shown in FIGS. 7A–11G, tool 34 is just one of a plurality of tools that may be provided as a set for use in soft tissue therapy according to the present invention. It is noted that the tools illustrated herein do not comprise an exhaustive list of tools that may be required for treatment of all soft tissue areas used, but are merely illustrative of the different shapes and sizes of tools that may be utilized to treat some parts of the body according to the present invention. In addition, it is noted that each of the tools shown herein may be used on different parts of the body as needed. In FIGS. 7A–7C, a tool 58 is shown including end portions 60 and 62 and having a flat edge 64 and a so-called "blade" edge that is tapered as best shown in FIG. 7C. It is noted that blade edge 66 of tool 58, as well as the blade edges of the remaining tools, are preferably rounded to a radius of 50° or greater. Tool 58 is especially useful on larger soft tissue areas such as a back muscle or a hamstring. In FIGS. 8A–8D there is shown a tool 68 including handle portions 70 and 72 and having blade edges 74 and 76 as well as flat edges 78 and 80 at handles 72 and 70, respectively. FIGS. 9A–9D illustrate yet another tool 82 including handle portions 84 and 86. Handle portion 84 includes flat edges 88 and 90. The contoured portions of tool 82 include both a bevelled edge 92 and a blade edge 94. Finally, referring to FIGS. 11A–11G, there is shown a tool 96 having handle portions 98 and 100. The contoured portions of tool 96 include a bevelled edge 102 and a blade edge 104.

As further shown in FIG. 1, positive electrode, or cathode, 23 is inserted into a receptacle located at end portion 38 of tool 34. Cathode 23 may be electrically connected to tool 34 by any conventional electrical connective method, such as a plug or screw connection. Although shown only with regard to tool 34 in FIG. 1, similar electrode connections may be formed in any of the other tools of the set. Negative electrode, or anode, 27 shown in this instance in the form of a circular pad, is shown in FIG. 1 positioned in the vicinity of the "belly" of quadricep muscle 22. Anode 27 may be maintained in the position shown in FIG. 1 by any method known in the art, such as a strap (not shown). Lead cord 25 extending from cathode 23 and lead cord 29 extending from anode 27 are attached to source 31 of electrical current. Source 31 is shown schematically in FIG. 1.

Source 31 may be any source of current used in conventional electrical stimulation therapy ("electrotherapy"). Preferably, source 31 is capable of generating the various waveforms commonly utilized in electrotherapy, and is capable of providing varied pulse rates. One such device that is appropriate for use in the present invention is the Rich-Mar Theratouch 4.7, available from Rich-Mar Corporation of Inola, Okla. Cathode 23 and anode 27 are also available from Rich-Mar. Preferably, anode 27 comprises a conventional circular padded electrode, however other electrodes presently used for this purpose are also acceptable. Anode 27 may be adhered to muscle 22 by any method known in the art, such as by a strap.

In order to perform soft tissue massage according to the present invention, a gel, such as ALOE—SOUND GEL PLUS, also available from Rich-Mar, is first applied to the affected soft tissue area and to the area to be covered by the anode. As used herein, the term "soft tissue" generally refers to a muscle, ligament, tendon, or any combination thereof. It is noted that the system of the present invention may be used on any part of the body in which a soft tissue injury has occurred and scar tissue has been built up as a result of the healing process. The particular soft tissue area illustrated herein, a knee joint, is merely illustrative of one possible application of the present invention.

Once the affected soft tissue area has been properly lubricated, a tool such as tool 34 is selected which has a contoured portion 40 that matches the contour of the affected joint. Cathode 23, electrically connected to source 31, is plugged into the receptacle at end 38 of tool 34. Anode 27, also electrically connected to source 31, is positioned at the belly of muscle 22, in a manner well known in the art of electrotherapy. The appropriate waveform and pulse is then selected by the therapist, and the appropriate controls on source 31 are adjusted to provide the desired output. For edema reduction, high voltage pulsed galvanic (HVPG) current is preferred.

Tool 34 is then passed across the knee joint in the direction of the arrows as shown in FIG. 1 so that the precise location of scar tissue 32 is determined. Generally, "bumps" may be felt through the tool to indicate the presence of scar tissue at a particular location on the soft tissue. Such scar tissue is often undetectable by merely using one's hands alone. It is noted that the bevelled edge is very useful for locating hardened scar tissue or tissue close to bone, whereas the blade edge is useful for locating scar tissue that is not in such a hardened state.

Once the location of the scar tissue is determined, the scar tissue must be broken up. This is accomplished by movement of tool 34 in the manner shown in FIG. 1 so that bevelled edge 50 breaks up hardened scar tissue 32. Once tissue 32 begins to break up, an irritation occurs which causes swelling of the scar tissue. The electrical stimulation provided to the patient through tool 34 acts upon and reduces this irritation.

Treatment may be continued with another tool. For example, as shown in FIG. 3, tool 68 may then be selected for further treatment of the illustrated knee joint. Electrode 23 is disconnected from tool 34, and connected to a receptacle at end 70 of tool 68. Tool 68 includes a contoured portion 106 that matches the contour of the knee joint as shown in FIG. 3. In particular, blade edge 76 of contoured portion 106 is manipulated under scar tissue 32 in the direction of the arrows of FIG. 3 so that scar tissue 32 is pulled in a cross fiber fashion. In this way, scar tissue 32 is pulled away from the individual fibers of ligament 30.

Figure 12:
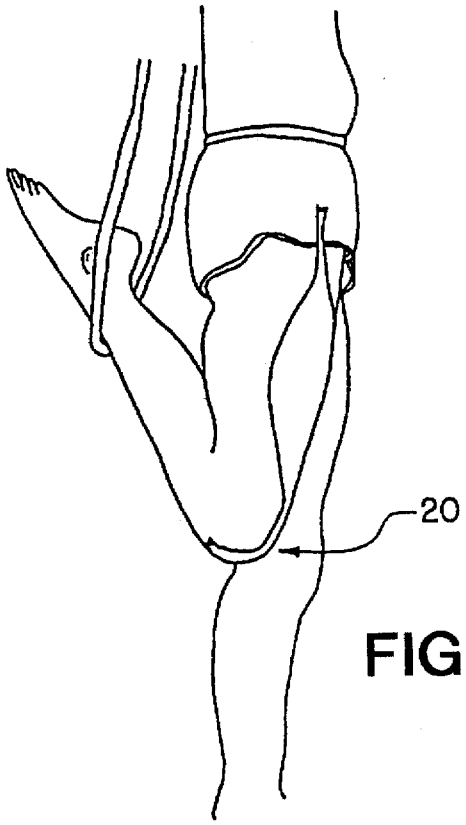
FIG. 12 is a perspective view particularly illustrating the soft tissue of the knee joint in a fully extended position.
Figure 13:
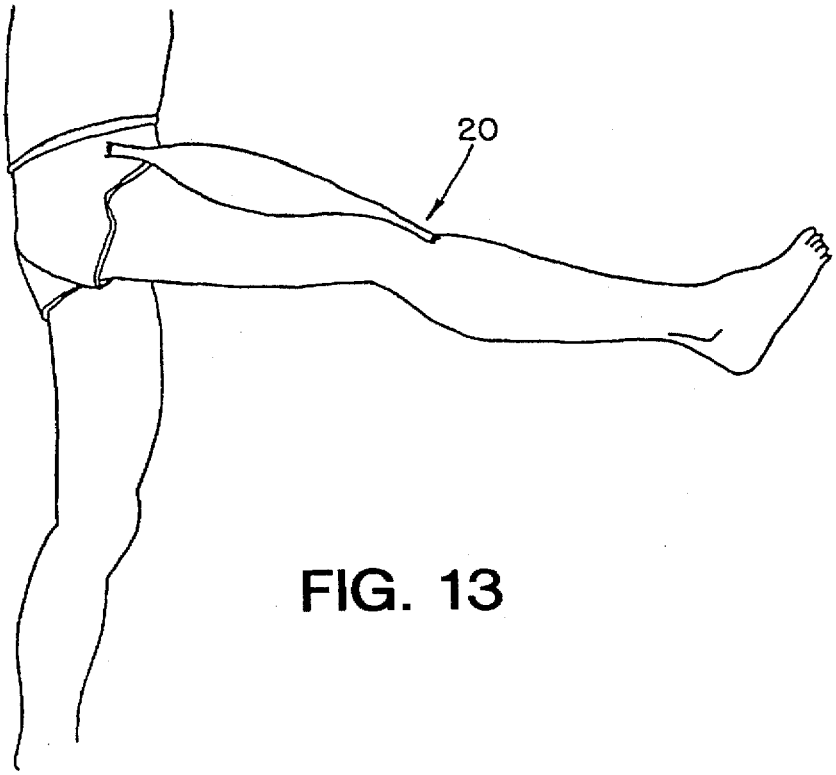
FIG. 13 is a perspective view similar to FIG. 12, except that the soft tissue of the knee joint is shown in its fully shortened position.

Once the scar tissue has been loosened from the affected soft tissue area, it is necessary to increase the range of motion of the joint. As shown in FIGS. 12 and 13, this is accomplished by working the soft tissue areas of the patella through a full range of motion. As shown in FIG. 12, the knee joint is fully flexed and should remain flexed for at least ten seconds. This allows the muscles, tendons, and ligaments to lengthen since the scar tissue has less of a hold on the joint. The soft tissue areas are then shortened as shown in FIG. 13 to complete movement of the joint throughout its full range of motion.

Figure 5:
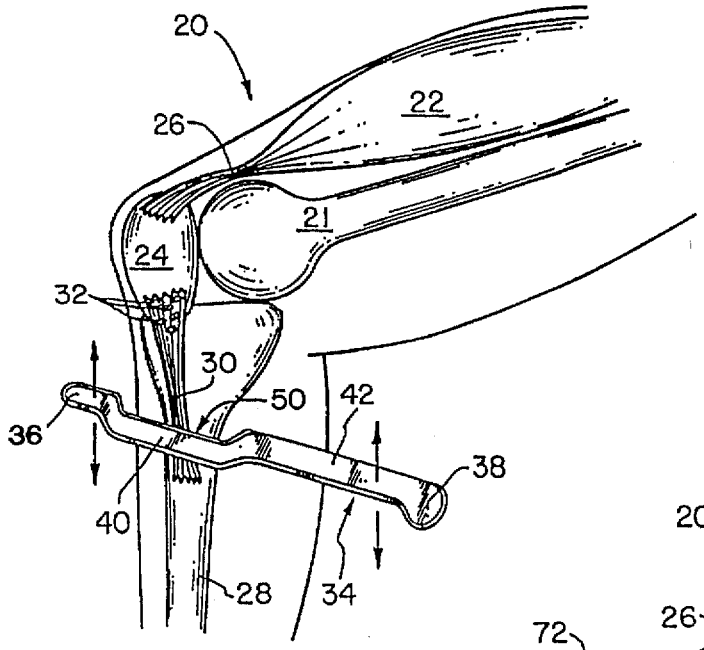
FIG. 5 is a view similar to that shown in FIG. 3, except that the scar tissue is shown being broken up as a result of repeated engagement with the tool shown in FIG. 1.
Figure 6:
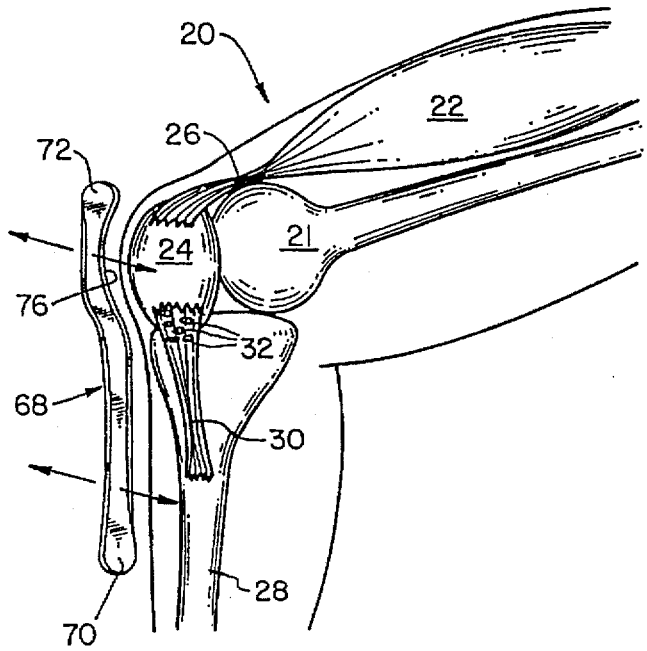
FIG. 6 is a view similar to that shown in FIG. 3, except that the scar tissue is shown being broken up as a result of repeated engagement with the tool shown in FIG. 3.

After the joint has been moved as shown in FIGS. 12 and 13, the soft tissue massage should be performed again in the same manner as described above. This additional massage helps to further break up scar tissue as shown in FIGS. 5 and 6, wherein the electrodes, electrical connections and source are omitted for purposes of clarity. Once the massage has been performed for a second time, there is less scar tissue than when the joint was stretched the first time. At this point the patient must try to achieve a greater range of motion than previously. Again, the joint is stretched as shown in FIGS. 12 and 13. This stretching exercise should be conducted so that the joint is held in each of the illustrated positions for a longer period of time than for the previous stretching exercise. The entire procedure is then again repeated until the scar tissue has been alleviated and full flexibility has been regained. This often requires many daily sessions of therapy. At the end of each session, the affected soft tissue area should be applied with ice to reduce swelling and bruising and speed recovery.

As discussed previously, each of the above tools includes either a bevelled edge or a blade edge for making contacting engagement with the scar tissue. The bevelled edge provides for massaging at a less intense pressure making this edge useful for the initial breaking up of the scar tissue. In addition, the bevelled edge may be rocked back and forth across bone to help break up hardened scar tissue located near bone. The blade edge provides for massaging at a much more intense pressure, which is useful for separating the soft tissue areas from one another to break up scar tissue. In addition, the blade edge is useful for pulling the irritated and broken up scar tissue away from the affected soft tissue areas. It is appreciated that other types edges may be utilized in addition to the blade and bevelled edges described herein.

It has been previously noted that the contoured portion of each tool of the set is specially configured for a particular joint or soft tissue area that is subject to the build up of scar tissue. These tools may be sized according to joint size (i.e. small, medium, large). Additionally, the optimal configuration of the skin contacting portion for a particular tool for each joint size may be determined by measuring a number of randomly selected joints and arriving at an "average" joint shape. Such an average shape would allow for deviations among individual joints. It is noted that the contour of a selected soft tissue area may be determined by both the underlying bone structure and the surrounding soft tissue area. In addition, the contour may be affected by other factors such as the particular position of a joint. Therefore, many tools of varying shapes and sizes may be utilized to achieve the desired results.

The shape of the tools may also be modified so that the tools may be used by either left-handed trainers or right-handed trainers. Furthermore, some tools may be configured to include both a bevelled edge and a blade edge so that a single tool may be used for several scar removing functions. An example of such a tool is shown in FIGS. 9A–9D. Similarly, the tools may be configured to include a variety of differently shaped contoured portions so that a single tool may be used for various joints or affected soft tissue areas. In addition, the handle portions of the tools may be modified as needed to allow the trainer more leverage as well as to permit the trainer to reach soft tissue areas which may otherwise be difficult to reach and apply soft tissue therapy thereto.

Although it is intended that the tools include a receptacle or other connecting mechanism for connection to a source of electrical current, it is not necessary that every tool in a set include such a connector. A therapist may prefer that certain tools not be used for electrotherapy, therefore these tools need not include a connecting mechanism. For example, the therapist may prefer to vary the treatment such that a treatment including electrical stimulation be followed by a treatment not including such stimulation, and vice versa.

Although the method and system of the present invention has been described for use on the human body, it is not intended to be specifically limited to such use. For example, the teachings of the present invention may be extended to use with animals, such as race horses, and even pets.

It will be appreciated that the foregoing is presented by way of illustration only, and not by way of any limitation, and that various other alternatives and modifications may be made to the illustrated embodiment without departing from the spirit and scope of the invention.

What is claimed is:

1. A system for use by a trainer for loosening fibrous scar tissue adhesions from underlying soft tissue of a patient, comprising:

an elongate rigid body having a first end and a second end, a first flat surface and a second flat surface opposite from said first flat surface, and a peripheral edge extending about the circumference of said body, wherein a portion of said peripheral edge is configured in the shape of an arc corresponding to the shape of a contour of a selected part of a patient's anatomy from which a scar tissue adhesion is to be loosened from the underlying soft tissue, wherein a second portion of said peripheral edge includes a tapered surface to define an edge, and wherein said body includes an electrical connector; and a source of electrical current connected to said body at said electrical connector for passing electrical current through said rigid body to the scar tissue adhesion of the patient.

2. The system of claim 1, wherein said arc shaped portion of said peripheral edge includes said tapered surface.

3. The system of claim 1, wherein said tapered surface comprises a beveled edge.

4. The system of claim 1, wherein said tapered surface comprises a blade edge.

5. The system of claim 4, wherein said blade edge is rounded to a 50° radius or better.

6. The system of claim 1, wherein said electrical connector is positioned at one of said first and second ends of said body.

7. The system of claim 1, wherein said body is made of stainless steel.

8. The system of claim 1, wherein said source of electrical current is capable of providing electrical current in a plurality of waveforms.

9. A method of loosening a fibrous scar tissue adhesion from underlying soft tissue of a patient, comprising the steps of:

providing a massaging tool having a curvilinear skin-contacting portion generally matching the contour of the soft tissue;

connecting said tool to a source of electrical current in such a manner that a stimulating electrical current passes through said tool; and electrically stimulating said adhesion while passing the curvilinear portion of the tool across the skin of the patient, said tool being passed across said skin in a manner to cause noninvasive contact of the skin-contacting portion of the tool with the scar tissue adhesion sufficiently to loosen the adhesion from the soft tissue.

10. The method of claim 9, including the step of lubricating the surface of the skin before passing the tool thereacross.

11. The method of claim 9, including the step of passing the tool across the skin sufficiently to determine the location of the fibrous adhesion on the soft tissue.

12. The method of claim 9, wherein said step of electrically stimulating includes manipulating the adhesion sufficiently to loosen the adhesion from the underlying soft tissue.

13. The method of claim 9, including the step of stretching the soft tissue to a maximum possible length after passing the tool across the skin, thereby increasing the range of motion of the soft tissue area.

14. The method of claim 9, wherein said source of electrical current is capable of providing electrical current in a plurality of waveforms.

15. A method of loosening a fibrous scar tissue adhesion from underlying soft tissue of a patient, comprising the steps of:

providing a massaging tool having a curvilinear skin-contacting portion generally matching the contour of the soft tissue;

providing a source of electrical current;

establishing an electrical connection by connecting said massaging tool to said source of electrical current via a cathode, and by connecting an anode to said source;

positioning the anode in closely spaced relationship to the scar tissue adhesion by contacting a tissue adjacent to said scar tissue adhesion with said anode; and passing the curvilinear portion of the tool across the skin of the patient in such a manner to cause noninvasive contact of the skin-contacting portion of the tool with the scar tissue adhesion sufficiently to loosen the adhesion from the soft tissue and to transmit electrical current from said tool to said scar tissue adhesion.

16. The method of claim 15, including the step of lubricating the surface of the skin before passing the tool thereacross.

17. The method of claim 15, including the step of passing the tool across the skin sufficiently to determine the location of the fibrous adhesion on the soft tissue.

18. The method of claim 15, including the step of stretching the soft tissue to a maximum possible length after passing the tool across the skin, thereby increasing the range of motion of the soft tissue area.

19. The method of claim 15, wherein said source of electrical current is capable of providing electrical current in a plurality of waveforms, and includes means for selecting a desired waveform.

20. The method of claim 15, wherein said massaging tool comprises a first massaging tool, and wherein said method further comprises providing a second massaging tool, said second massaging tool being shaped differently from said first massaging tool, and thereafter repeating said method with said second massaging tool in place of said first massaging tool.

21. A method of loosening a fibrous scar tissue adhesion from underlying soft tissue of a patient comprising providing a generally non-pliable massaging tool having a skin contacting portion, passing the massaging tool across the skin of the patient in such a manner to cause non-invasive contact of the skin contacting portion of the tool with the scar tissue adhesion for mechanically loosening the scar tissue adhesion, connecting the tool to a source of electrical current in such a manner that a stimulating electrical current passes through said tool; and electrically stimulating at least one of the underlying soft tissue and the scar tissue adhesion while passing the massaging tool across the skin of the patient for permitting the electrical stimulation to reduce the irritation caused by the scar tissue.

22. The method of claim 21 wherein the step of providing the massaging tool comprises the step of providing a massinging tool having a curvilinear skin contacting portion.

23. The method of claim 21 wherein the step of providing the massaging tool comprises the step of providing a massaging tool having a beveled edge.

24. The method of claim 21 further comprising the step of passing the messaging tool across the skin of the patient to locate the scar tissue adhesion.

* * * * *